United States Patent [19]

de Vries et al.

[11] Patent Number: 4,859,309

[45] Date of Patent: Aug. 22, 1989

[54] PROCESS FOR THE PREPARATION OF LIGHT HYDROCARBON DISTILLATES BY HYDROCRACKING AND CATALYTIC CRACKING

[75] Inventors: Auke F. de Vries; Willem H. J. Stork, both of Amsterdam, Netherlands

[73] Assignee: Shell Oil Company, Houston, Tex.

[21] Appl. No.: 213,732

[22] Filed: Jun. 20, 1988

[30] Foreign Application Priority Data

Nov. 17, 1987 [GB] United Kingdom ..... 8726838

[51] Int. Cl.[4] ..... C10G 69/04

[52] U.S. Cl. ..... 208/61; 208/58; 208/80

[58] Field of Search ..... 208/58, 61, 80, 112, 208/111, 1 B, 120, 78

[56] References Cited

U.S. PATENT DOCUMENTS

| | | | |
|---|---|---|---|
| 3,098,029 | 7/1963 | Synder, Jr. | 208/61 |
| 3,268,437 | 8/1966 | Beuther et al. | 208/61 |
| 3,287,254 | 11/1966 | Paterson | 208/80 |
| 3,671,420 | 6/1972 | Wilson et al. | 208/61 |
| 3,728,251 | 4/1973 | Kelley et al. | 208/61 |
| 3,736,249 | 5/1973 | Lawson, Jr. | 208/80 |
| 3,751,360 | 8/1973 | Bernstein | 208/58 |
| 3,781,197 | 12/1973 | Bryson et al. | 208/120 |
| 4,151,070 | 4/1979 | Allan et al. | 208/80 |
| 4,713,221 | 12/1987 | Montgomery et al. | 208/61 |
| 4,762,607 | 8/1988 | Aldridge et al. | 208/78 |

OTHER PUBLICATIONS

"Catalysts Have Large Effect in Refinery-Process Economics", van Kessel et al., O&GJ, vol. 85, No. 7, 2/16/87, pp. 55-66.

*Primary Examiner*—Anthony McFarlane
*Attorney, Agent, or Firm*—Kimbley L. Muller

[57] ABSTRACT

A process is disclosed for the preparation of a light hydrocarbon oil distillate by (1) hydrocracking a vacuum distillate, (2) separating the product of (1) into distillates and a residue, (3) catalytic cracking the residue obtained in (2) and a portion of the vacuum distillate to thereby isolate a light hydrocarbon oil distillate.

4 Claims, 2 Drawing Sheets

PROCESS FOR THE PREPARATION OF LIGHT HYDROCARBON DISTILLATES BY HYDROCRACKING AND CATALYTIC CRACKING

FIELD OF THE INVENTION

The invention relates to a process for the preparation of one or more light hydrocarbon oil distillates by applying the following steps:

step 1: hydrocracking a vacuum heavy hydrocarbon oil distillate, step 2: separating the product obtained in step 1 by means of distillation into one or more distillates and a residue, step 3: catalytically cracking the residue obtained in step 2, and step 4: isolating one or more light hydrocarbon oil distillates from the product obtained in step 3.

In the atmospheric distillation of crude mineral oil, as applied on a large scale in refineries in the preparation of light hydrocarbon oil distillates, for example gasoline fractions, a residual oil is obtained as a by-product. Gasolines, as referred to herein, are those fractions having a boiling range at atmospheric pressure between that of n-pentane and 220° C. To increase the yield of light hydrocarbon oil distillates from the crude oil concerned, a heavy hydrocarbon oil distillate can be separated from said residual oil by vacuum distillation, which hydrocarbon oil distillate can be converted in a relatively simple way by hydrocracking or by catalytic cracking into one or more light hydrocarbon oil distillates.

BACKGROUND OF THE INVENTION

The process to which the invention relates is described in "Oil & Gas Journal", Feb. 16, 1987, pages 55–66 and meets the increasing demands for middle distillates, i.e. those having an atmospheric boiling range between 180° C. and 370° C.

SUMMARY OF THE INVENTION

It has now been found that, among the light hydrocarbon oil distillates, gasoline fractions are obtained in a surprisingly high yield when making a proper use of the catalytic cracking of a residue acquired from hydrocracking a vacuum heavy hydrocarbon oil distillate.

Accordingly, the invention provides a process for the preparation of one or more light hydrocarbon oil distillates by applying the following steps:

step 1: hydrocracking a vacuum heavy hydrocarbon oil distillate, step 2: separating the product obtained in step 1 by means of distillation into one or more distillates and a residue, step 3: catalytically cracking the residue obtained in step 3, and step 4: isolating one or more light hydrocarbon oil distillates from the product obtained in step 3, characterized in that the residue obtained in step 2 is catalytically cracked in step 3 together with a further quantity of said vacuum heavy hydrocarbon oil distillate.

DETAILED DESCRIPTION OF THE DRAWINGS

Figure 1:
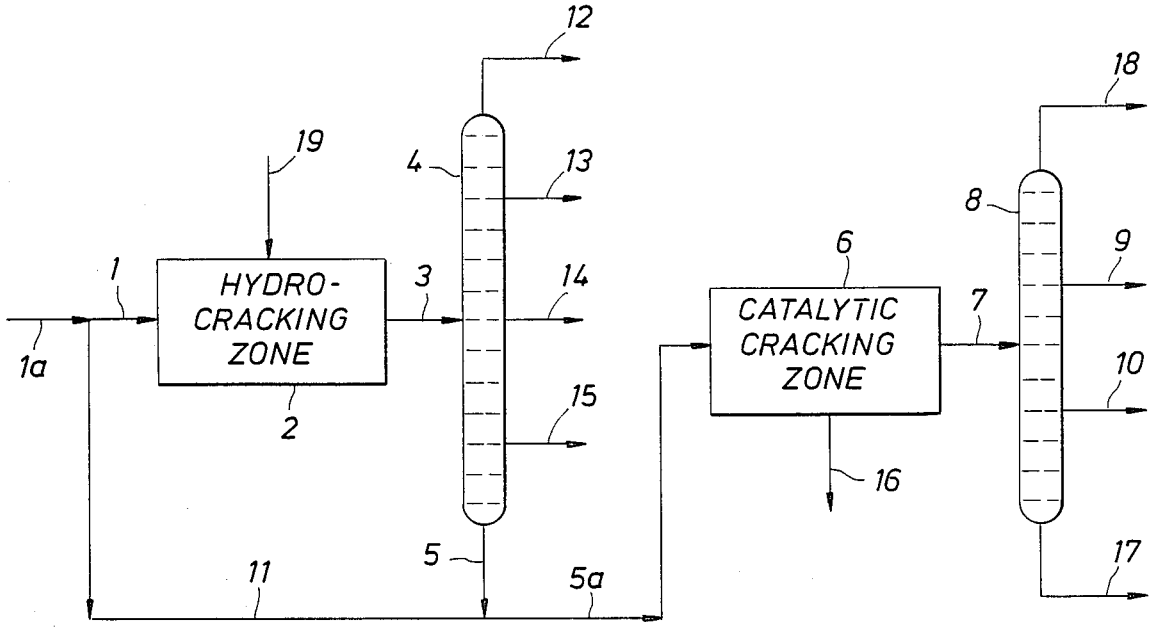
FIG. 1 is a schematic representation of the process of this invention.

Referring to FIG. 1, a vacuum heavy hydrocarbon oil distillate (hereinafter also referred to as "vacuum distillate") is introduced via a line 1*a* and a line 1 into a hydrocracker 2 in which the oil is hydrocracked (step 1). The product obtained in hydrocracker 2 is conducted through a line 3 and introduced into a distillation column 4 in which it is distilled with formation of a residue (step 2) which is withdrawn from column 4 via a line 5. This residue is introduced via the lines 5 and 5*a* into a catalytic cracker 6 in which the residue is catalytically cracked (step 3). The product obtained in catalytic cracker 6 is withdrawn therefrom via a line 7 and introduced via this line into a distillation column 8 from which a gasoline fraction is withdrawn via a line 9 (step 4) and a middle distillate fraction via a line 10. A spent catalyst stream is withdrawn from catalytic cracker 6 in line 16 and passed to appropriate regeneration facilities. An overhead stream 18 and a bottom stream 17 are withdrawn from distillation column 8.

According to the present invention, vacuum distillate is introduced into the catalytic cracker 6, in the case as shown by branching off from the line 1*a*, conducting it via a line 11 and introducing it into line 5*a* where it is mixed with the residue conducted through the line 5.

Figure 2:
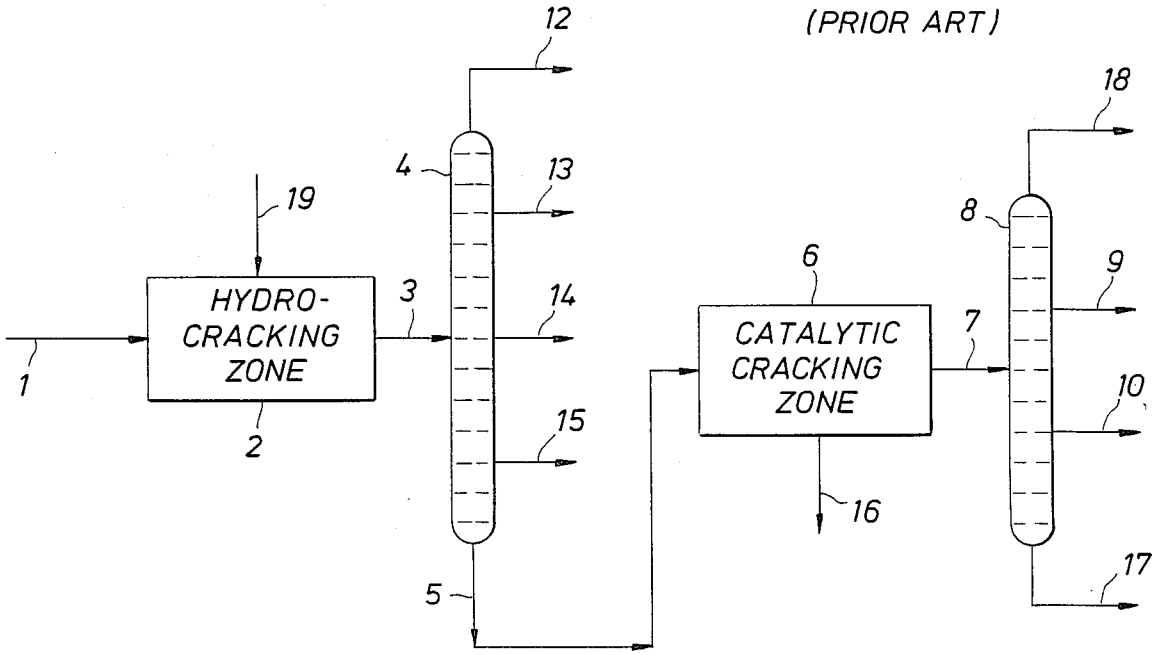
FIG.2 (PRIOR ART)
FIG. 2 is a schematically representation of the process of the prior art.

The reference numbers in FIG. 2 have the same meaning as the corresponding reference number in FIG. 1; the differences with FIG. 1 are that line 11 is not present in FIG. 2 and that line 5 runs from distillation column 4 to catalytic cracker 6.

The proper use of the catalytic cracking in step 3, mentioned hereinbefore, means that the residue obtained in step 2 (conducted through the line 5, see FIG. 1) is catalytically cracked in step 3 together with a further quantity of said vacuum distillate (conducted via the line 11, see FIG. 1). This use of the catalytic cracker results in a surprisingly high yield of gasoline, taking into account the yields of gasoline obtained by (1) the prior art process represented by FIG. 2, and (2) a prior art process in which all of the vacuum distillate conducted through line 1 (see FIG. 2) is not sent to the hydrocracker 2 but introduced directly in the catalytic cracker 6.

The yield of gasoline in the process according to the present invention is surprisingly high, because it is significantly higher than could be expected on the basis of linear interpolation between the gasoline yields obtained in processes (1) and (2) mentioned hereinbefore.

The vacuum distillate to be hydrocracked in step 1 may be any vacuum distillate obtained from crude mineral oil. Preferably, the vacuum distillate is a vacuum gas oil having a boiling range at atmospheric pressure in the range of from 200° C. to 600° C. Such gas oils may be a mixture of gas oils obtained by vacuum distillation (that is to say at sub-atmospheric pressure) and gas oils obtained by distillation at atmospheric pressure.

DETAILED DESCRIPTION OF THE INVENTION

In the hydrocracking in step 1 lighter products are formed. This hydrocracking is mild, that is to say only a part of the vacuum heavy hydrocarbon oil distillate is cracked. The products formed are mainly in the kerosine and gas oil range, but gasoline and gas are also formed. Furthermore, sulphur compounds and nitrogen compounds, which are usually present in the vacuum distillate, are simultaneously converted in step 1, in hydrogen sulfide and ammonia, respectively. Hydrocracking is preferably carried out at a temperature in the range of from 375° C. to 450° C., a pressure in the range of from 10 to 200 bar, a space velocity in the range of from 0.1 to 1.5 kg of vacuum distillate per liter of catalyst per hour and a hydrogen to vacuum distillate ratio in the range of from 100 to 2500 Nl per kg. In step 1 a catalyst is suitably applied which contains nickel and/or cobalt and, in addition, molybdenum and/or a tungsten on a carrier, which contains more than 40% by weight of alumina. Very suitable catalysts for application in step 1 are catalysts comprising the combination cobalt/molybdenum on alumina as carrier or nickel/-molybdenum on alumina as carrier.

Step 2 is preferably carried out so as to obtain a residue having a boiling point at atmospheric pressure of at least 300° C.

In the process according to the present invention a considerable portion of the feed to step 3 is converted into distillate fractions. In the catalytic cracking process, which is preferably carried out in the presence of a zeolitic catalyst, coke is deposited on the catalyst. This coke is removed from the catalyst by burning off during a catalyst regeneration step that is combined with the catalytic cracking, whereby a waste gas is obtained substantially consisting of a mixture of carbon monoxide and carbon dioxide. Catalytic cracking is preferably a carried out at a temperature in the range from 400° C. to 550° C. and a pressure in the range of from 1 to 10 bar. Furthermore, catalytic cracking is preferably carried out at a severity, indicated with "$V_s$", in the range of from 2.0 to 5.0, "$V_s$" being defined as $$\frac{\text{weight of catalyst}}{\text{weight of feed}} \times t^{\alpha}$$

"t" being the contact time in seconds, between the catalyst and the feed, and $\alpha$ being equal to 0.30.

The process according to the present invention may be carried out using a weight ratio of vacuum distillate which is catalytically cracked to vacuum distillate which is hydrocracked in step 1 which is not critical and may vary within wide ranges. This weight ratio is suitably in the range of from 0.01 to 1.0 and is preferably in the range of from 0.1 to 0.6.

ILLUSTRATIVE EMBODIMENTS

The following Examples further illustrate the invention. In the Examples "% wt" and "ppm" mean "per cent by weight" and "parts per million by weight", respectively. The boiling points given are at atmospheric pressure.

A number of experiments are carried out in the manner as described hereinbefore with respect to FIGS. 1 and 2. The vacuum distillate conducted through line 1 has the following properties:

| | |
|---|---|
| initial boiling point | below 228° C. |
| 10% wt recovered at | 331° C. |
| 50% wt recovered at | 436° C. |
| 90% wt recovered at | 532° C. |
| final boiling point | above 548° C. |
| Ramsbottom Carbon Test | 0.24 |

-continued

| | |
|---|---|
| Sulphur content, calculated as S | 1.94% wt |
| nitrogen content, calculated as N | 1400 ppm |
| nickel content, calculated as Ni | 0.6 |
| vanadium content, calculated as V | 1.0 |
| density 70° C./4° C. | 0.8781 |

The total content of carbon in aromatic structure and hydrogen bound is carbon in aromatic structure is 14.79% wt.

| The conditions in the hydrocracker 2 are: | |
|---|---|
| Temperature, °C. | 394 |
| Pressure, bar | 62.5 |
| Weight hourly space velocity, kg of feed per liter of catalyst per h | 0.78 |
| Hydrogen to feed ratio, Nl per kg | 330 |

Hydrocracking is carried out in the presence of the SHELL ®-S-424 catalyst. This catalyst contains 3.0% wt of nickel, calculated as Ni and 12.9% wt of molybdenum, calculated as Mo (both on total catalyst) on alumina as the carrier. The catalyst has a surface area of 160 $m^2/g$, a pore volume of 0.45 ml/g and a compacted bulk density of 0.82–0.83 kg/l. The catalyst is used as three-lobed extrudates having a largest dimension of 1.2 mm.

The residue withdrawn from the distillation column 4 via the line 5 has the following properties:

| | |
|---|---|
| initial boiling point | 370° C. |
| Ramsbottom Carbon Test | 0.12 |
| sulphur content, calculated as S | 0.0556% wt |
| nitrogen content, calculated as N | 320 ppm |
| density 70° C./4° C. | 0.8533 |

The total content of carbon in aromatic structure and hydrogen bound to carbon in aromatic structure is 11.15% wt. Nickel and vanadium could not be detected in the residue.

The residue in line 5 is obtained in a yield of 59.5% wt, calculated on vacuum distillate in line 1.

In all experiments described hereinafter the catalytic cracker 6 is operated so as to obtain the maximum gasoline yield and to produce in total 6.0% wt of coke.

Six experiments are carried out, according to the present invention, and are referred to hereinafter as Examples 1 to 6. In the Examples 140.5 parts by weight of the vacuum distillate is conducted via the line 1*a* (see FIG. 1) and split into 100 parts by weight through line 1 and 40.5 parts by weight through line 11. The residue withdrawn from the distillation column 4 (see FIG. 1, 59.5 parts by weight) is mixed with 40.5 parts by weight of vacuum distillate, originating from the line 11 and the mixture thus obtained (100 parts by weight) is conducted via the line 5*a* into the catalytic cracker 6. Catalytic cracking is carried out in the presence of a zeolitic catalyst and at a a pressure of 2 bar. In each Example a different temperature is used in the catalytic cracker 6. Table 1 hereinafter states these temperatures in column 1 and presents in column 5 the yield of gasoline (withdrawn via the line 9), expressed in per cent by weight on vacuum distillate conducted through the line 1*a*.

TABLE 1

| 1 | 2 | 3 | 4 | 5 | 6 | 7 | 8 | 9 |
|---|---|---|---|---|---|---|---|---|
| | | Yield of gasoline, % wt | | | | | | |
| Temp., °C. | Comp. Exp. | | Example | | | | Comp. Exp. | |
| 480 | A1 | 53.9 | 1 | 52.2 | I1 | 50.5 | A2 | 45.6 |
| 490 | B1 | 53.3 | 2 | 51.8 | I2 | 50.4 | B2 | 46.1 |
| 500 | C1 | 52.3 | 3 | 51.4 | I3 | 49.9 | C2 | 46.3 |
| 510 | D1 | 51.4 | 4 | 50.8 | I4 | 49.4 | D2 | 46.6 |
| 520 | E1 | 50.4 | 5 | 50.0 | I5 | 48.8 | E2 | 46.5 |
| 530 | F1 | 49.2 | 6 | 49.1 | I6 | 47.9 | F2 | 46.0 |

Table 2 states, for each comparative experiment, the severity which is applied and the maximum net conversion observed.

TABLE 2

| Comp. Exp. | A1 | B1 | C1 | D1 | E1 | F1 | A2 | B2 | C2 | D2 | E2 | F2 |
|---|---|---|---|---|---|---|---|---|---|---|---|---|
| severity sec 0.30 | 3.9 | 3.8 | 3.8 | 3.7 | 3.6 | 3.6 | 3.1 | 3.1 | 3.0 | 2.9 | 2.8 | 2.8 |
| Max. net conversion, % wt | 73.3 | 74.0 | 74.7 | 75.5 | 76.2 | 76.9 | 66.1 | 66.8 | 67.5 | 68.2 | 68.9 | 69.9 |

Table 3 states, for each example, the severity which is applied and the maximum net conversion observed.

TABLE 3

| Example | 1 | 2 | 3 | 4 | 5 | 6 |
|---|---|---|---|---|---|---|
| Severity, sec 0.30 | 3.4 | 3.4 | 3.4 | 3.3 | 3.3 | 3.2 |
| Max. net conversion, % wt | 70.4 | 71.1 | 71.9 | 72.6 | 73.3 | 74.0 |

Six further experiments are carried out, not according to the present invention, and are referred to herein as Comparative Experiments A1 to F1. The experiments A1–F1 were a repetition of the Examples 1–6, respectively, with the difference that the residue withdrawn from the distillation column 4 (see FIG. 2) is not mixed with vacuum distillate 100 parts by weight of vacuum distillate being conducted into the hydrocracker 2. The yield of gasoline found in each of these experiments is stated in Table 1 in column 3.

Six other experiments are carried out, not according to the present invention, and are referred to herein as Comparative Experiments A2 to F2. In these experiments the vacuum distillate (100 parts by weight) is introduced directly into the catalytic cracker 6, no hydrocracking applied at all. The yield of gasoline found in each of these experiments is stated in Table 1 hereinbefore in column 9.

Subsequently, the yields obtained in Comparative Experiments A1 and A2 are used to predict the yield of gasoline which could be expected for Example 1 on the basis of this yield being directly proportional to the fraction of vacuum distillate in the feed to the catalytic cracker 6. For example, on this basis, the yield of gasoline which can be expected in Example 1 is $0.595\times53.9+0.405\times45.6=50.5\%$.

This percentage is mentioned in Table 1 hereinbefore in the top of column 7 and is referred to as "I1". Similar calculations have been made for the combinations B1–B2, C1–C2, D1–D2, E1–E2 and F1–F2. The results of these calculations are mentioned in Table 1, column 7 and are referred to as "I2", "I3", "I4", "I5" and "I6".

A comparison between the yield obtained in Example 1 (52.2%) and that calculated as "I1" (50.5%) shows that the former is significantly higher. This higher percentage illustrates the synergistic effect of the process according to the present invention. Table 1 shows a similar synergistic effect by comparing the yield of Example 2 with "I2", of Example 3 with "I3", of Example 4 with "I4", of Example 5 with "I5" and of Example 6 with "I6".

Figure 3:
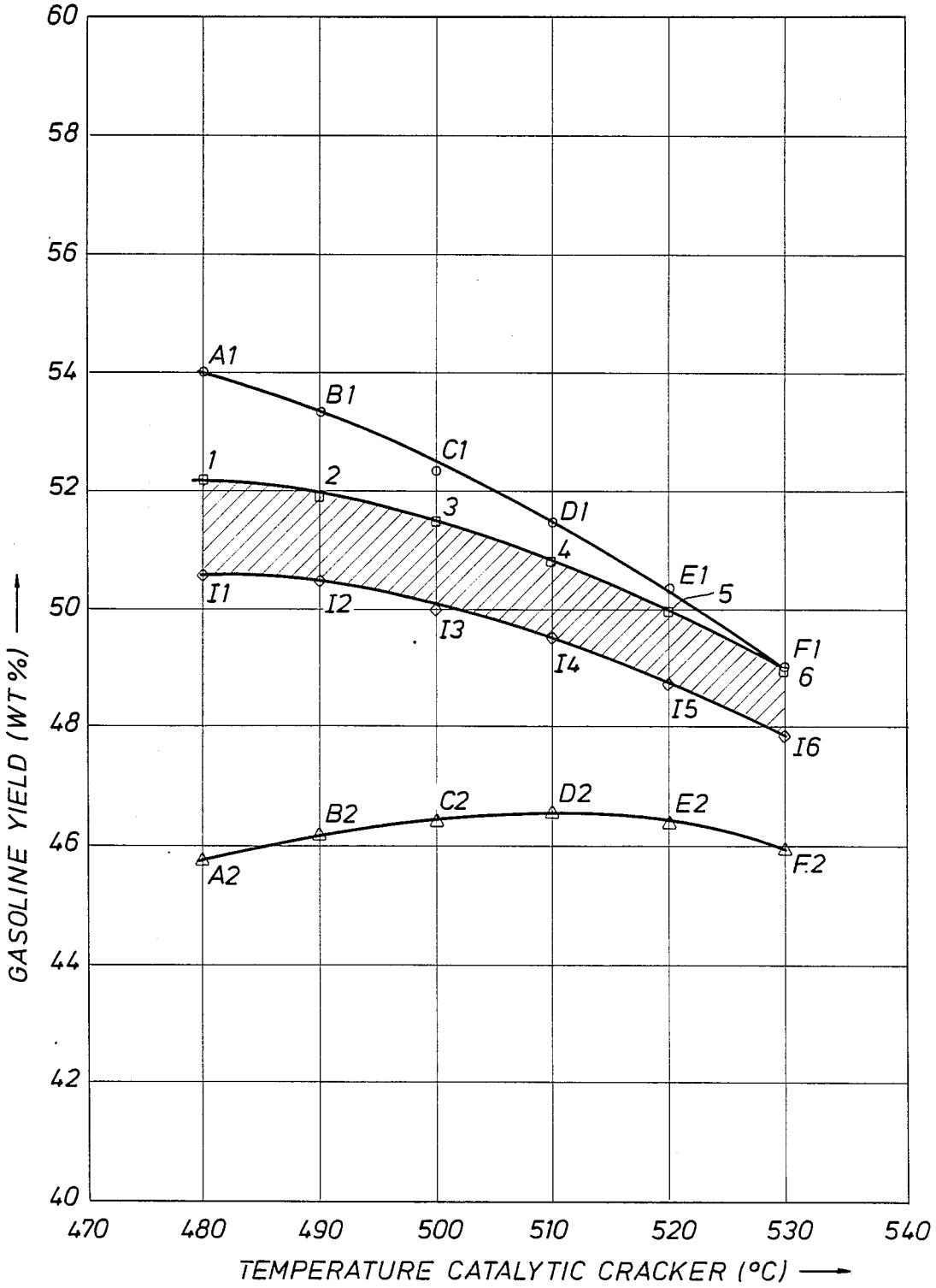
FIG. 3 shows in graphic from the synergestic effect of the process of this invention in the hatched area.

In FIG. 3 of the attached drawing, the gasoline yield, expressed in % wt, and the temperature applied in the catalytic cracker 6 are plotted along the vertical and horizontal axis, respectively. In FIG. 3, the Examples are indicated with a square, the Comparative Experiments A1–F1 with a + (plus), the Comparative Experiments A2–F2 with a # and the calculated yields I1–I6 with a * (asterisk). The numerals next to a square refer to the Examples having the same numeral. The indications A1–F1 next to a + refer to the Comparative Experiments having the same indication. The indications A2–F2 next to a # refer to the Comparative Experiments having the same indication. The indications I1–I6 next to a * refer to the same indications in the Table hereinbefore.

The synergistic effect of the process according to the present invention is demonstrated by the hatched area in FIG. 3.

What I claim as my invention is:

1. A process for the preparation of a gasoline range petroleum distillate from a vacuum heavy hydrocarbon oil distillate which comprises:

(a.) passing at least a portion of said vacuum heavy hydrocarbon oil distillate to a hydrocracking zone to hydrocrack said distillate at a temperature in the range of from 375° C. to 450° C., a pressure in the range of from 10 to 200 bar, a space velocity in the range of from 0.1 to 1.5 kg of vacuum heavy hydrocarbon oil distillate per liter of catalyst per hour and a hydrogen to vacuum heavy hydrocarbon oil distillate ratio in the range of from 100 to 2500 Nl per kg into a product stream comprising a hydrocracked distillate residue having an initial boiling point of at least 300° C.;

(b.) passing said hydrocracked distillate of step a. to a distillation separation zone to separate and recover said residue;

(c.) passing said residue to a catalytic cracking zone to catalytically crack said residue at a temperature in the range of 400° C. to 550° C., a pressure in the range of from 1 to 10 bar and at a severity ($V_s$) in the range of from 2.0 to 5.0, wherein ($V_s$) is defined as:

$$\frac{\text{weight of catalyst}}{\text{weight of feed}} \times t^{\alpha}$$

where t is the contact time in seconds, between the cracking catalyst and said residue, and $\alpha$ is equal to 0.30 to said gasoline range petroleum distillate;

(d.) passing at least a portion of said vacuum heavy oil distillate of step a. prior to hydrocracking to said catalytic cracking of step c. to catalytically crack said vacuum heavy oil distillate at a temperature in the range of 400° C. to 550° C., a pressure in the range of from 1 to 10 bar and at a severity ($V_s$) in the range of from 2.0 to 5.0, wherein ($V_s$) is defined as:

$$\frac{\text{weight of catalyst}}{\text{weight of feed}} \times t^{\alpha}$$

where t is the contact time in seconds, between the cracking catalyst and said vacuum, and $\alpha$ is equal to 0.30 to said gasoline range petroleum distillate in association with said catalytic cracking of said residue in step c. and (e.) withdrawing said gasoline range petroleum distillate from said catalytic cracking zone.

2. The process as claimed in claim 1 in which said hydrocracking in step a. is performed in the presence of a catalyst containing the combination of nickel-molybdenum on alumina as a carrier or cobalt-molybdenum on alumina as a carrier.

3. The process as claimed claim 1 in which said cracking catalyst comprises a zeolitic catalyst.

4. The process as claimed in claim 1 wherein the weight ratio of vacuum heavy hydrocarbon oil distillate catalytically cracked in said catalytically cracking zone to vacuum heavy hydrocarbon oil distillate hydrocracked in said hydrocracking zone is in the range of from 0.1 to 0.6.

* * * * *